US006026599A

United States Patent [19]

Blackwell et al.

[11] Patent Number: 6,026,599

[45] **Date of Patent: *Feb. 22, 2000**

[54] PSEUDO-PLANAR INSOLE INSERT

[76] Inventors: Terry Dean Blackwell, 3421 SE. St., Topeka, Kans. 66609; Jeffrey S. Brooks, 1140 Loi Rd., St. Louis, Mo. 63124

[ * ] Notice: This patent issued on a continued prosecution application filed under 37 CFR 1.53(d), and is subject to the twenty year patent term provisions of 35 U.S.C. 154(a)(2).

[21] Appl. No.: 09/024,489

[22] Filed: Feb. 17, 1998

Related U.S. Application Data

[63] Continuation-in-part of application No. 08/861,579, May 22, 1997, Pat. No. 5,787,610, which is a continuation-in-part of application No. 08/654,726, May 29, 1996, abandoned.

[51] Int. Cl.[7] ..... A61F 5/14

[52] U.S. Cl. ..... 36/140; 36/173; 36/174; 36/180; 36/43

[58] Field of Search ..... 36/43, 44, 140, 36/88, 91, 94, 166, 173, 174, 176, 178, 180, 181

[56] References Cited

U.S. PATENT DOCUMENTS

| | | | |
|---|---|---|---|
| 1,728,243 | 9/1929 | Marshalek | 36/176 |
| 1,957,695 | 5/1934 | Chiapetta | 36/181 |
| 1,992,081 | 2/1935 | Madinger | 36/178 |
| 2,161,565 | 6/1939 | Freda | 36/180 |
| 2,252,936 | 8/1941 | Leydecker | 36/178 |
| 2,628,440 | 2/1953 | Leydecker | 36/180 |
| 3,591,882 | 7/1971 | Pearsall | 36/44 |
| 4,266,350 | 5/1981 | Laux | 36/44 |
| 4,360,027 | 11/1982 | Friedlander et al. | 36/140 |
| 4,813,157 | 3/1989 | Boisvert et al. | 36/91 |
| 4,841,648 | 6/1989 | Shaffer et al. | 36/44 |
| 5,058,585 | 10/1991 | Kendall et al. | 36/140 |
| 5,787,610 | 8/1998 | Brooks | 36/174 |

*Primary Examiner*—M. D. Patterson
*Attorney, Agent, or Firm*—Lathrop & Gage, L.C.

[57] ABSTRACT

A flexible insole insert comprises a body having a planar first member and a planar second member secured to the first member. The second member has a heel portion, with a medial portion and a lateral portion, and an arch portion. A foremost extremity of the arch portion passes beneath the second and third metatarsals of a user's foot. An inner edge of the second member passes beneath the lateral cuneiform and a medial outer edge passes under the navicular of the user's foot. The relative thicknesses of the first member and second member are dimensioned to moderate any ridging and creasing effects which might be caused in the sole of the user's foot by the second member. A metatarsal cutout, generally centered beneath the user's first metatarsal joint, has a longitudinal edge spaced between the user's first and second metatarsals and a transverse edge spaced rearwardly from the user's first metatarsal. A longitudinally shaped heel cutout is generally centered beneath the user's heel. The insole insert is structured to cooperatively redistribute weight-generated forces normally by suspending the heel and first metatarsal shifting weight by bridging the forefoot and rearfoot.

36 Claims, 2 Drawing Sheets

PSEUDO-PLANAR INSOLE INSERT

CROSS REFERENCE TO RELATED APPLICATION

This application is a continuation-in-part application of co-pending application Ser. No. 861,579 filed May 22, 1997, now U.S. Pat. No. 5,787,610, which issued Aug. 4, 1998, which in turn is a continuation-in-part application of Ser. No. 654,726, filed May 29, 1996, now abandoned, the contents of which are incorporated herein by reference.

BACKGROUND OF THE INVENTION

1. Field of the Invention

This invention relates generally to footwear and, more specifically without limitation, to an insole insert for footwear.

2. Description of the Related Art

Although children are usually born with normal arches, as a child begins to walk and body weight is applied to his feet as they bear against a supporting surface, his foot structure necessarily reacts by tending to flatten out under the weight-generated forces applied to the soles of his feet. If the child were walking only on natural supporting surfaces, e.g., the ground, the normal age for the child to be able to stand without the need of external support for his feet is generally considered to be approximately eight years of age. For purposes of improved appearance, convenience, endurance, etc., however, man-made products are generally applied to those supporting surfaces. Unfortunately, such "improved" surfaces tend to be detrimental to the human musculoskeletal structures, especially during the developmental stages when the child's foot structure is "soft" and incompletely formed. Due to such negative environmental influences on the human foot structure, shoes which provide proper support and shock attenuation should be worn for protection and prevention of structural injury.

As disclosed in U.S. Pat. No. 4,272,899, issued Jun. 16, 1981 to Jeffrey S. Brooks, the disclosures and teachings of which are incorporated herein by reference, a contoured insole structure may be provided in children's shoes to reduce abnormal stress from the heel to the metatarsals by properly supporting and stabilizing the feet during development thereof. By so doing, the associated stresses placed upon the medial column of the foot is also reduced, distributing the body weight more evenly on the sole of the foot.

More specifically, when walking or running, the lateral (outside) portion of the heel is generally the first part of the foot to strike the ground, with the foot then pivoting on the heel to bring the lateral part of the forefoot into a position whereat it bears against an underlying surface. At that point, the foot resides in a supinated (inclined upwardly from the lateral to the medial side of the foot). The foot then pronates until all of the metatarsal heads are in the horizontal plane (flat to the supporting surface) and the heel ideally is oriented perpendicularly to the underlying surface. The foot is then in a neutral position with the subtalar joint neither pronated nor supinated. The bone structural alignment should be firmly supported when the foot assumes such neutral position in order to prevent the ligaments, muscles and tendons of the foot from becoming over-stressed.

Various skeletal characteristics of the feet that are pertinent to proper foot support include the first, second, third, fourth and fifth metatarsal heads, indicated in phantom at M1 through M5 in FIG. 1; first, second, third, fourth and fifth metatarsal necks associated with the respective metatarsal heads M1–M5, indicated in phantom at N1 through N5; first, second, third, fourth and fifth proximal phalanges spaced distally from the respective metatarsal heads M1–M5, indicated in phantom at P1 through P5; and first, second, third, fourth and fifth metatarsal phalangeal joints spaced between the respective metatarsal heads M1–M5 and proximal phalanges P1–P5, indicated at J1 through J5 in FIG. 1. Further, various muscles and tendons characteristically interact to stabilize the foot during the sequence of progressive movements normally experienced in a walking or running gait in preparation for movement from the neutral position to a propulsive phase of the gait cycle, sometimes referred to as "toe-off" or "push-off".

Flexion of the first metatarsal phalangeal joint (i.e., the great toe joint) is normally approximately fifteen degrees to the associated metatarsal in a dorsiflexed position when standing, and increases between sixty-five and ninety degrees, depending on the available motion and the activity required by the joint just prior to lifting off the underlying supporting surface. The relationship among the foot bones is such that the first metatarsal phalangeal joint and the two small bones there beneath, the tibial sesamoid and the fibular sesamoid, should be displaced downwardly ("plantarflex") in order for the toe to function appropriately.

Thus, the progressive phases of gait are heel strike, when the heel hits the ground; distance, when stability of the arch is an essential necessity; and propulsive phase, as the heel lifts off the ground and the body weight shifts onto the ball of the foot. During the transition from the neutral position through toe off, it is preferable that the second and third metatarsals be firmly supported, and that the first metatarsal head plantarflex (move downward) relative the second and third metatarsal heads. The toes also should generally be firmly supported during toe-off so that they remain straight, and thus stronger, promoting a "pillar effect" by the phalanges.

To provide additional insight into some of the mechanisms of the human feet, it is known that the lower limbs of the human embryo begin to rotate internally ninety degrees from an external position at the pelvic girdle at approximately the eighth week of fetal development. At the twelfth week of development, the feet begin to dorsiflex, and around the sixteenth week of development, the completely inverted feet begin to event, all of which are part of the complex preparation of the lower extremity for upright, bi-pedal weight-bearing posture and locomotion. A child's feet and legs have sometimes been described as a loose bag of bones and cartilage floating in a mass of soft tissue until about age six. As a result, foot posture is a rapidly changing proposition for children under the age of six years. The true structure of a child's foot is not developed until approximately seven or eight years of age when development of the sustentaculum tali is generally complete. Further, eighty to ninety percent of the child's adult foot size is developed by the age of ten, with complete development occurring by approximately age 14–16 years in human females and age 15–17 years in human males.

When infants begin to bear weight, their feet begin to pronate excessively because their feet are not yet ready, without deformation, to be placed on an unnatural surface, such as a hard flat surface. As a result, if uncorrected, repeated weight-generated forces may cause these early weight-bearing feet to permanently deform (excessive pronation). Thus, such early-age, weight-bearing feet should preferably be maintained in proper postural alignment by providing a more natural environment therefor, such as a better supporting interface between the feet and the underlying supporting surfaces, thereby allowing the feet to develop as normally as possible during their postnatal development.

Therefore, as soon as the child begins to bear weight on his feet, usually around six to seven months of age, treatment to neutralize excessive pronation should be instituted. The user's feet should be placed in their individually most efficient position to function properly and to reduce excessive strain not only on the feet but also on the lower body structure supported by the feet. In an ideal foot posture situation for minimal stress, the position in which the feet as weight-bearing organs would normally realize greatest efficiency (including an optimal ratio of supination and pronation) is one in which the subtalar joint is approximately forty-two degrees from the transverse plane, approximately sixteen degrees from the saggital plane, and approximately forty-eight degrees from the frontal plane, sometimes referred to as the neutral position hereinbefore mentioned. In the neutral position, the leg and calcaneus are perpendicular to the weight bearing surface, and the knee joint, ankle joint and forefoot, including the plane of the metatarsal heads, are substantially parallel to the subtalar joint and to the walking surface.

A fully developed human foot can generally be described as having one of three basic types: normal, low arch ("flat foot"), or high arch. From an anatomical standpoint, normal and flat feet are capable of being functionally controlled by the same basic shoe control mechanism, while a high-arch foot is structurally different and may require a different supporting environment. For example, the amount of adduction ("pigeon-toedness") of the front part of a normal or flat foot in relation to the heel area of the foot is typically slight, while the amount of adduction in a high-arch foot is generally much greater. Further, the movement of a normal or flat foot during running is also substantially different from that of a high-arch foot. If proper support and stabilization is not properly implemented during their early formative development, fully developed feet may be more susceptible to, and be more prone to suffer from, various maladies, including the following:

(a) tearing of the plantar fascia tissues which connect the heel to the ball of the foot and support the arch of the foot, sometimes referred to as "plantar fascial tears" or "plantar fasciitis", which generally arise from stressful upward pulls on the calcaneus ("heel bone") and strain of the intrinsic or interior foot muscles, and is generally realized as heel pain;

(b) excessive stress between adjacent metatarsals, sometimes referred to as "metatarsal stress fractures", generally arising from improper support of the talonavicular joint ("arch") and instability of the first ray ("great toe joint");

(c) irritation of the tissue associated with a small bone beneath the great toe joint, sometimes referred to as "tibial sesamoiditis", generally arising from inappropriate support of the talonavicular joint and/or inappropriate weight distribution between the various metatarsal phalangeal joints;

(d) excessive bony growth on the top of the foot, sometimes referred to as "saddle joint deformity", generally arising from improper movement of the first metatarsal and realized in the form of degenerative arthritis;

(e) inflammation and/or separation of tissue from the tibia, sometimes referred to as "shin splint", generally arising from improper articulation of the talonavicular joint between the ankle bone and the key supporting bone of the foot and generally realized as fatigue of the muscles in the front and back of the leg; and (f) bruising in the bottom center of the heel generally arising from disproportionally greater weight-generated forces applied thereto.

Such maladies should be given due consideration, both in youth and in adults, as the human foot may start to breakdown as a result of degenerative disease by the age of thirty-five years.

In view of the foregoing, it should be obvious that certain parts of the feet are generally subjected to higher stresses during standing, running and walking, and that other parts of the feet require different degrees of support for maximum biomechanical efficiency, particularly since high impact forces to the foot are generally transferred to other skeletal structures, such as the shins, knees, and lower back region.

Control of the user's foot must begin in the heel and proceed to the arch, including providing stability of the forefoot in order for the foot to function properly through the normal phases of gait. Various devices have been developed in attempts to provide needed support and stabilization for a user's feet. A frequent problem with most of such devices, however, is getting the devices to not only properly fit the user's feet but, in the case of insole inserts, to also fit the user's shoes while properly supporting and stabilizing the user's feet.

Thus, what is needed is a device, when placed into footwear, provides an appropriate amount of support and shock attenuation for different regions of the foot to thereby provide a proper environment that promotes a balanced foot position for healthy postural and skeletal structural development thus allowing the parts of the foot to function in a way which provides maximum efficiency, to prepare the body for stresses normally subjected thereto, and to protect those parts of the foot which are subjected to high impact forces.

SUMMARY OF THE INVENTION

An improved insole insert, comprising An insole insert comprises a body having a planar first member constructed of flexible material and having a uniform thickness and constructed of flexible material, the first member having a heel edge, a lateral side edge, and a medial side edge; and a planar second member constructed of flexible material and having a uniform thickness that is substantially thinner than the thickness of the first member.

The second member has a heel portion with a medial portion extending along the medial side edge, a rear portion extending along the heel edge, and a lateral portion extending along the lateral side edge of the first member. The second member also has an arch portion configured such that a foremost extremity thereof operatively passes beneath the second, third and fourth metatarsal necks of the user's foot. An inner edge of the second member is configured to operatively pass beneath the lateral margin of the internal cuneiform bone and the navicular bone of the user's foot. The relative thicknesses of the first member and second member are dimensioned to moderate any ridging and creasing effects which might otherwise be operatively caused in the sole of the user's foot by the second member.

A metatarsal cutout, formed in the second member, is dimensioned and configured to be generally operatively centered beneath the user's first metatarsal joint. The metatarsal cutout has a longitudinal edge spaced operatively between the user's first and second metatarsals and a transverse edge spaced operatively just rearwardly from the user's first metatarsal phalangeal joint to pass beneath the first metatarsal neck of the user's foot.

A longitudinally shaped heel cutout, formed in the second member, is dimensioned and structured to be generally operatively centered beneath the user's heel.

The heel portion, the arch portion, the metatarsal cutout, and the heel cutout are dimensioned and configured to cooperatively redistribute weight-generated forces normally bearing against the central portion of the heel, the sesamoids, and the first metatarsal head of the user's foot. Through the particular applied-shape technology, sometimes referred to as the "seven-shape" technology, the increased weight-generated forces normally bearing against the more bony regions of the heel, the sesamoids, and the first metatarsal head of the user's foot are substantially reduced and redistributed proximally. This is accomplished by allowing the mid-portion of the foot (the more fleshy regions of the foot) to share the weight by creating a bridge of material between the heel and the forefoot and suspension of the center of the heel, the sesamoids, and the first metatarsal during midstance and propulsive phases of gait.

PRINCIPAL OBJECTS AND ADVANTAGES OF THE INVENTION

The principal objects and advantages of the present invention include: providing a device for insertion into existing footwear; providing such a device that is tailored to the biomechanical operation of the wearer's foot; providing such a device for properly supporting and cushioning various regions of the wearer's foot; providing such a device that redistributes weight-generated forces applied to the more bony regions of the heel, sesamoids, and fifth metatarsal joint of the wearer's foot to other larger and more fleshy regions of the sole of the user's foot; and generally providing such a device that is efficient in operation, reliable in performance, and is particularly well adapted for the proposed usage thereof.

Other objects and advantages of the present invention will become apparent from the following description taken in conjunction with the accompanying drawings, which constitute a part of this specification and wherein are set forth exemplary embodiments of the present invention to illustrate various objects and features thereof.

DETAILED DESCRIPTION OF THE INVENTION

Figure 1:
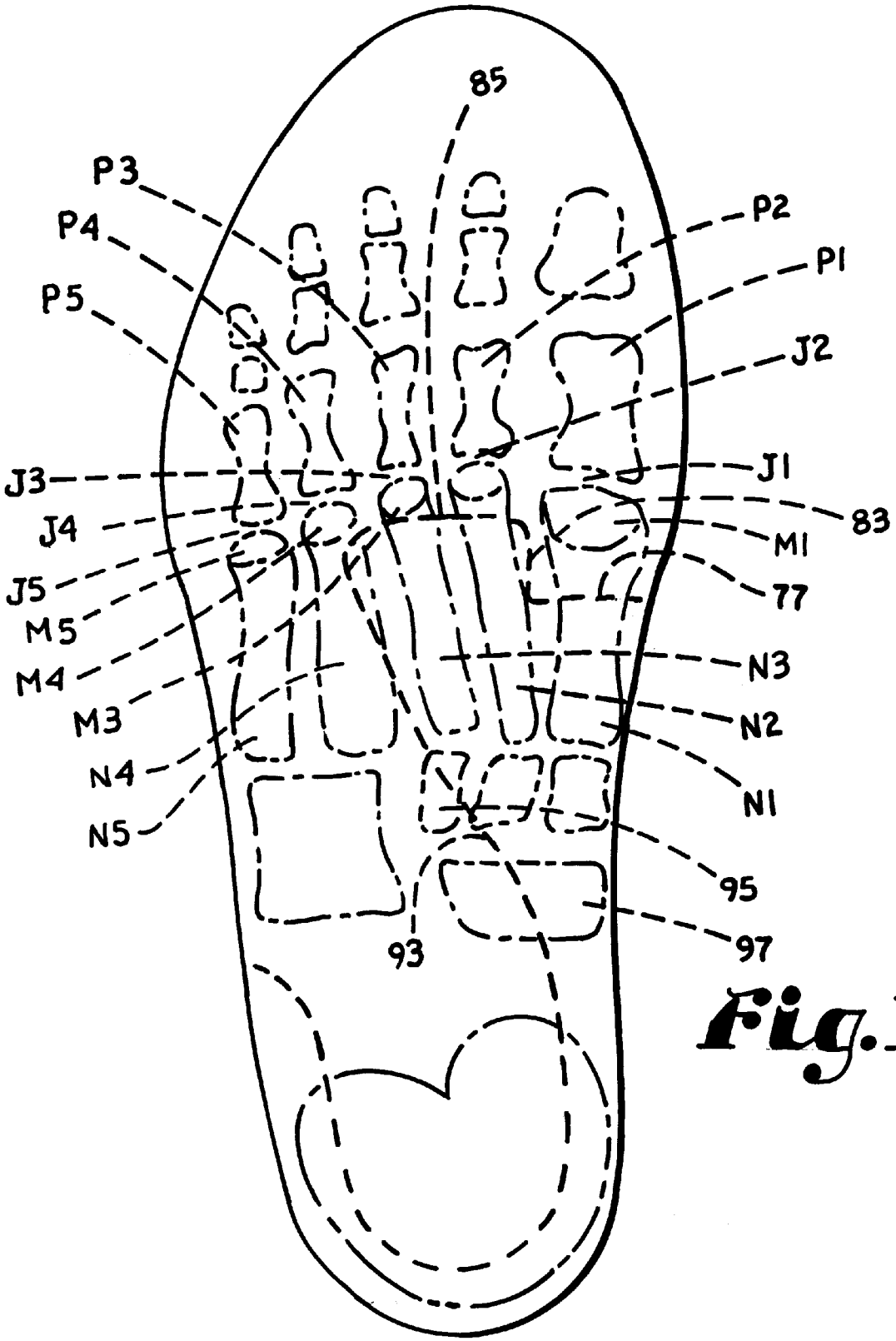
FIG. 1 is a schematic illustration, showing a top plan view of insole of a left shoe and illustrating the approximate position of the metatarsal and related bone structure of a user's left foot in relation thereto.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a pseudo-planar insole insert in accordance with the present invention, as shown in FIGS. 1 through 5. The pseudo-planar insole insert 1 comprises a body member 11 having a first or upper member 13 with a planar first upper surface 15 for comfortable stable support of a wearer's foot and a planar second or second surface 17, and a second or second member 23 with a planar first or upper surface 25 and a planar second or lower surface 27 for generally bearing against the insole of a wearer's shoe.

The first member 13 and the second member 23 are molded, glued, or otherwise formed or constructed from one or more pliable materials that provides the desired cushioning, light weight, physical characteristics, wearability, breathability, rot resistance, slip resistance, durability for long use, and relative inertness that does not commonly contribute to allergic reactions when in contact with skin. For example, the first member 13 may be formed of any suitable material, such as DPU sometimes referred to as blown thermoplastic rubber, polyurethane, TPR, PVC, EVA or other material well known to those of ordinary skill in the art of footwear. Preferably, the material selected is also one that may be treated with a pair of scissors or shears for more precisely adapting, or custom fitting, the pseudo-planar insole insert 1 to the footwear for which it is intended.

It is to be understood that for some applications, it may be desirable to reverse the relative spacing arrangement of the first member 13 and the second member 23. In other words, the second member 23 may be superimposed between the wearer's foot and the first member 13, whereas the first member 13 may be spaced between the second member 23 and the insole of the user's shoe.

If desired, the upper surface 15 of the body member 11 may be overlaid with a thin fabric liner or other suitable pliable sheet-like material, to separate the sole of the wearer's foot from direct contact with the body member 11; such a liner may be constructed of an odor and/or moisture absorbing material, as known in the art, and may also be impregnated with an antibacterial and/or antimicrobial agent.

It is to be understood that the length and width of any particular one (or pair) of the pseudo-planar insole insert 1 may vary as is customary, depending upon the size of footwear for which that pseudo-planar insole insert 1 is intended. Various dimensions are quantified herein for exemplary purposes only; those quantities were observed for a pseudo-planar insole insert 1 of the present invention for a woman's size nine, oxford-type shoe, sometimes referred to herein as the "woman's size-nine exemplary specimen". It is to be understood that those dimensions may increase or decrease according to the shoe size for which a particular set of the pseudo-planar insole inserts 1 is to be utilized.

For purposes of reference herein, regions of the first member 13 are defined as a toe edge 31, a heel edge 33, a medial side edge 35, and a lateral side edge 37 corresponding to parts of the user's foot. The toe edge 31, the heel edge 33, the medial side edge 35, and the lateral side edge 37 are generally profiled and dimensioned to fit just within the corresponding sides and toe of the user's footwear. Also, the first member 13 preferably has a uniform thickness, generally in the range of approximately two to six millimeters. For example, the first member 13 of the woman's size-nine exemplary specimen of the pseudo-planar insole insert 1 has a thickness of approximately 5 mm.

The first member 13 preferably has a Type C (commonly referred to as "Shore C Scale") durometer hardness measured in accordance with American Society of Testing and Material (ASTM) standard D 2440-97 of less than about 70 and more preferably a hardness in a range of about 40–65. Depending upon the particular activity for which the footwear utilizing the pseudo-planar insole insert 1 is intended, however, the hardness may be greater or lesser as desired. For example, if the footwear is intended for walking, the first member 13 may have a Type C durometer hardness (ASTM D 2240-97) of about 45, whereas if the footwear is intended for running, the first member 13 may have a hardness of about 60. For general purpose applications, the pseudo-planar insole insert 1 may have a hardness of approximately 55 on the Shore C Scale. In short, the first member 13 should be sufficiently "soft" to provide shock attenuation, but sufficiently firm to provide stability to the user's foot.

The second member 23 is preferably constructed of the same type of material as the first member 13, with the first surface 25 thereof laminated or otherwise secured to the second surface 17 of the first member 13, such as by heat fusion, adhesive, a chemicsome curing process, or any other suitable method. For some applications, the second member 23 may have the same thickness as the first member 13 or, alternatively, the second member 23 may be thicker than the first member 13. The second member 23 generally has a uniform thickness in the range of two to six millimeters. Preferably, however, the second member 23 has a uniform thickness that is substantially thinner than the thickness of the first member 13. For example, in the woman's size-nine exemplary specimen of the pseudo-planar insole insert 1, the second member 23 has a thickness of approximately 2 mm.

It is to be understood that for some applications, it may be desirable to use cellular material for supporting purposes. For other applications, it may be desirable to use non-cellular material, such as an elastomeric material, for cushioning purposes. For yet other applications, it may be desirable to use non-cellular material for the first member 13 and cellular material for the second member 23.

If desired, such as for marketability purposes for example, the first member 13 and the second member 23 may be constructed of differently colored materials to enhance the aesthetic characteristics of the pseudo-planar insole insert 1 and/or to highlight the use of distinct layers for the first member 13 and the second member 23 that otherwise may appear to form a substantially planar unit when, in fact, the two-layer combination of the first member 13 and the second member 23 provides benefits not previously realized with prior art planar insole inserts.

The second member 23 has an inner edge 41, a heel edge 43, a medial side edge 45, and a lateral side edge 47. The heel edge 43, the medial side edge 45, and the lateral side edge 47 of the second member 23 are profiled and dimensioned to fit flush with, or just within as indicated by the dashed line designated by the numeral 51 in FIG. 2, the corresponding heel edge 33, the medial side edge 35, and the lateral side edge 37 of the first member 13. The inner edge 41 defmes the innermost extremities of an arch portion 53 and a heel portion 55 of the second member 23, wherein the heel portion 55 has a medial portion 63, a rear portion 65, and a lateral portion 67 as hereinafter described. The heel portion 55 can be described as having a U-shaped configuration. The medial portion 63, the rear portion 65, and the lateral portion 67 of the heel portion 55 have widths in the approximate range of ¼ inch to ¾ inch, depending on size of the user's foot.

Except for those applications wherein the second member 23 is operatively spaced above the first member 13, the overlaying of the first member 13 over the second member 23 effectively moderates any ridging and creasing effects in the user's sole by the inner edge 41 of the second member 23 lying within the confines of the toe edge 31, the heel edge 33, the lateral side edge 37, and the medial side edge 35 of the first member 13.

Figures 2, 3, 4, 5:
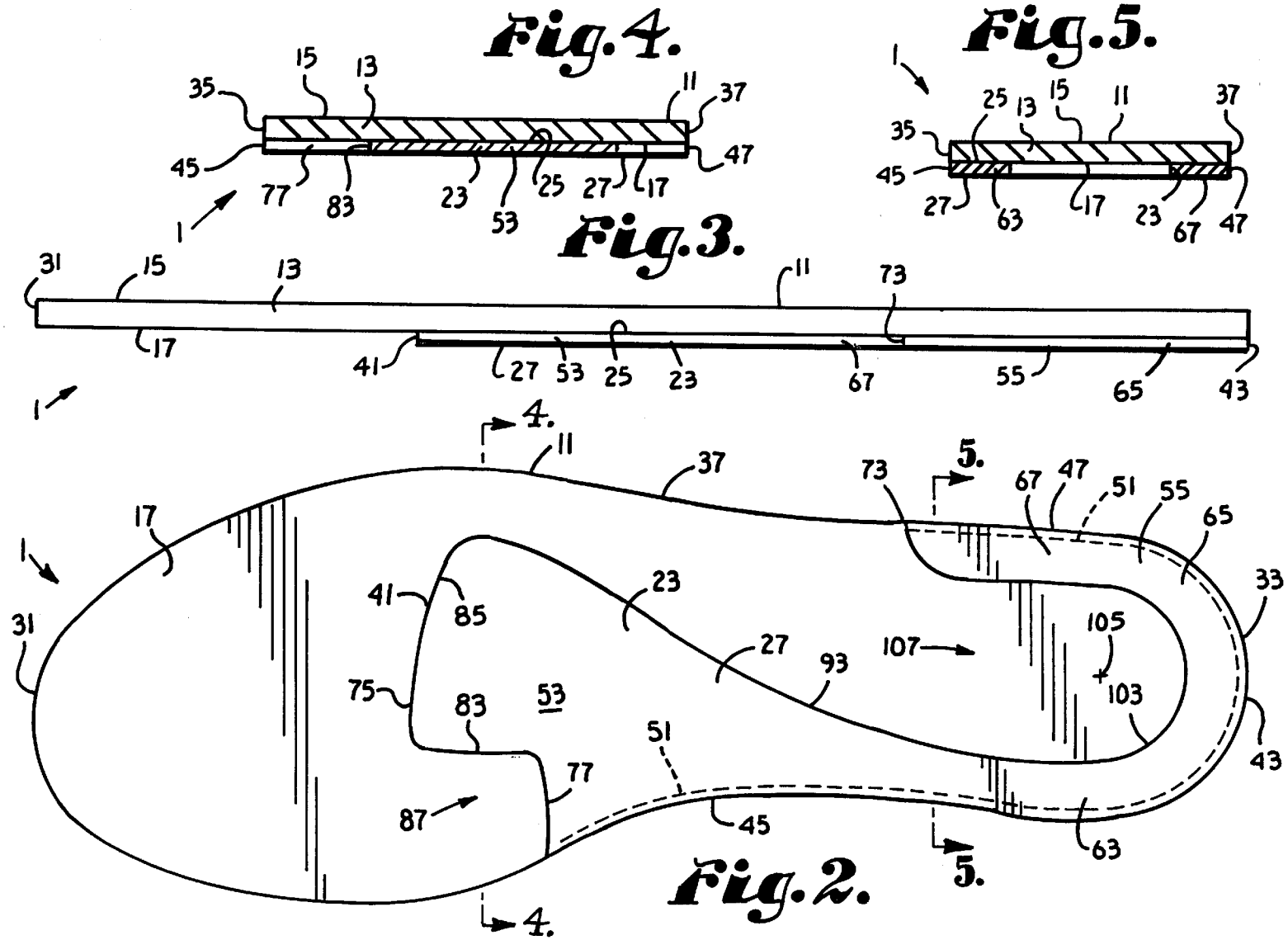
FIG. 2 is a bottom plan view of a pseudo-planar insole insert for a user's left foot, in accordance with the present invention.
FIG. 3 is a side elevational view taken from the lateral side of the pseudo-planar insole insert shown in FIG. 2.
FIG. 4 is a cross-sectional view of the pseudo-planar insole insert, taken along line 4—4 of FIG. 2.
FIG. 5 is a cross-sectional view of the pseudo-planar insole insert, taken along line 5—5 of FIG. 2, according to the present invention.

The lateral portion 67 of the heel portion 55 extends forwardly along the lateral side edge 37, as shown in FIG. 2, to terminate at a foremost end 73 thereof. Preferably, the lateral portion 67 of the heel portion 55 is configured to operatively extend distally to approximately beneath a distal end of the lateral margin of the plantar calcaneal tuberosity of the user's foot.

Similarly, the medial portion 63 of the heel portion 55 extends forwardly along the medial side edge 35 to join the arch portion 53, as shown in FIG. 2. The arch portion 53 extends forwardly along the medial side edge 35 from the medial portion 63 of the heel portion 55 to terminate at a fore medial segment 75 of the inner edge 41 as shown in FIG. 2, the fore medial segment 75 having a transverse segment 77, a longitudinal segment 83, and an intermediate segment 85. For example, the medial portion 63 and the arch portion 53 of the woman's size-nine exemplary specimen generally extends forwardly to approximately seventy percent of the overall length of the pseudo-planar insole insert 1.

More specifically, the longitudinal segment 83 is dimensioned and configured to be operatively spaced between the user's first and second metatarsal phalangeal joints J1, J2, and the transverse segment 77 is dimensioned and configured to be spaced just rearwardly from the first metatarsal phalangeal joint J1 such that the transverse segment 77 and the longitudinal segment 83 effectively form a metatarsal cutout 87 in the second member 23 to thereby provide operative flexibility for the first metatarsal phalangeal joint, such that the first metatarsal phalangeal joint and its associated plantar sesamoids can appropriately plantar flex between midstance and toe-off phases of a user's gait. The intermediate segment 85 of the inner edge 41 is dimensioned and configured to terminate approximately below the second, third, and perhaps fourth metatarsal necks to provide necessary stability and support therefor. In other words, the fore medial segment 75 passes approximately beneath the neck of the first metatarsal head, and the intermediate segment 85 passes approximately or directly beneath the second, third, and perhaps fourth metatarsals.

The metatarsal cutout 87 is configured to permit the user's first metatarsal-phalangeal joint J1 to move vertically downwardly while walking. The metatarsal cutout 87, which is generally spaced such that the user's first metatarsal phalangeal joint J1 is spaced approximately centrally there over, is configured to have sufficient horizontal dimensions to properly accommodate the user's paired sesamoid bones located beneath his first metatarsal joint J1 to thereby allow proper, natural flexion of the user's metatarsal phalangeal joints despite the user's foot being confined to an article of footwear.

More specifically, the metatarsal cutout 87 permits the first metatarsal phalangeal joint J1 to be displaced more naturally relative to the adjacent metatarsals to promote increased stability and greater balance to the extrinsic musculature of the foot and to minimize or eliminate the incidence of saddle joint deformity. Operatively depressing the first member 13 into the metatarsal cutout 87 is also configured to basically cup the first metatarsal phalangeal joint J1 to thereby essentially fix the support provided by the pseudo-planar insole insert 1 securely in the footwear against the user's foot and, additionally, to prevent forward slippage of the user's foot in the footwear.

It is to be understood that the metatarsal cutout 87 may have a generally trapezoidal, circular, rectangular, or triangular shape, or may have any other suitable shape so long as the metatarsal cutout 87 is properly dimensioned to, cooperatively with other components of the pseudo-planar insole insert 1, accomplish desired foot functioning and redistribution of the weight-generated forces bearing against the sole of the user's foot during the various phases of gait as described herein.

The inner edge 41 also includes an aft medial segment 93 of the pseudo-planar insole insert 1 that extends generally from the region of the third or fourth metatarsal joints J3, J4, continues rearwardly approximately beneath the lateral cuneiform bone 95, and curves gradually in a rearward and medial direction to pass approximately beneath the navicular bone 97 to then form the inner extremities of the medial portion 63, the rear portion 65, and the lateral portion 67 of the heel portion 55, as shown in FIGS. 1 and 2.

More specifically, the medial portion 63, the rear portion 65, and the lateral portion 67 of the heel portion 55 extend inwardly respectively from the medial side edge 45, the heel edge 43, and the lateral side edge 47 to form a generally semi-circular profile 103 about a center of curvature 105. As an example, each of the medial portion 63 and the lateral portion 67 of the heel portion 55 of the woman's size-nine exemplary specimen of the pseudo-planar insole insert 1 has a width transversely from the center of curvature 105 of approximately twenty percent of the overall transverse width of the pseudo-planar insole insert 1 through the center of curvature 105. Similarly, the rear portion 65 of the heel portion of the woman's size-nine exemplary specimen of the pseudo-planar insole insert 1 has a width directly rearwardly from the center of curvature 105 of approximately five percent of the overall length of the pseudo-planar insole insert 1.

The heel portion 55 and the arch portion 53 are configured and dimensioned to cooperatively redistribute the relatively large weight-generated forces normally bearing against the sesamoids and the central region of the user's heel, that are induced during various supported phases of the user's gait, to other areas of the user's sole that normally experience smaller weight-generated forces to thereby substantially reduce the range of such forces bearing against the sole of the user's foot. By arranging the medial portion 63, the rear portion 65, and the lateral portion 67 of the heel portion 55 along the medial side edge 35, the heel edge 33, and the lateral side edge 37 as herein described, the portions 63, 65, 67, in conjunction with each other and with the arch portion 53, operatively shift the weight-bearing forces normally bearing against the sole of the user's foot from the more bony structure of the user's heel outwardly toward the larger and more fleshy areas of the user's heel, arch, and forefoot.

In other words, the heel portion 55, in conjunction with the arch portion 53, is configured to redistribute the weight-generated forces from the center of the user's heel outwardly to thereby reduce or eliminate the incidence of bruising of the bottom center of the user's heel. In addition, the heel portion 43 and the arch portion 53 are cooperatively configured such that a larger portion of the user's body weight is distributed over a larger area of the sole of the user's foot.

Stated another way, the heel portion 55 and the arch portion 53 are cooperatively configured such that an increased portion of the user's weight is supported by the regions of the user's foot between the user's heel and forefoot, providing a bridging effect which operatively reduces the overall weight-bearing forces applied to the user's heel and forefoot during the midstance phase of the user's gait Due to the configuration of the heel portion 55 and the arch portion 53, the user's foot is supported at an elevation, i.e., suspended, slightly above the elevation at which it would otherwise be supported were it not for the heel portion 55 and the arch portion 53. As a result, the heel portion 55 and the arch portion 53, in conjunction with the metatarsal cutout 87, redistribute the larger weight-generated forces normally applied to the user's sesamoids away from the sesamoids toward other areas of the user's forefoot, such as the second and third metatarsals.

In so doing, the incidence of tibial sesamoiditis is thereby minimized or eliminated. Further, the arch portion 53 and the metatarsal cutout 87 are configured such that cooperative interaction therebetween reduces first ray instability by providing relatively more support to the talonavicular joint which, in turn, reduces the stress on adjacent metatarsals, thereby decreasing or eliminating the incidence of metatarsal stress fractures. Also, the arch portion 53 and the metatarsal cutout 87 are configured to promote more natural control of the talonavicular joint to thereby decrease or eliminate the incidence of shin splints and fatigue of the front and back leg muscles, and to thereby promote more efficient movement of the user's lower leg muscles.

The transverse spacing between the lateral portion 67 and the medial portion 63 of the heel portion 55 of the second member 23 effectively provide a heel cutout 107 operatively spaced below a central portion of the user's heel whereat the greatest weight-generated forces are normally applied. For example, transversely from the center of curvature 105, the heel cutout 107 of the woman's size-nine exemplary specimen of the pseudo-planar insole insert 1 has a width of approximately sixty percent of the overall transverse width through the center of curvature 105 of the pseudo-planar insole insert 1.

The operative structural and contour features of the pseudo-planar insole insert 1, namely the heel portion 55 and the arch portion 53, in conjunction with the heel cutout 107, are configured to redistribute the weight-generated forces normally applied in the central region of the user's heel outwardly therefrom to thereby reduce or eliminate the incidence of bruising in the central region of the user's heel.

Further, the metatarsal cutout 87, the heel portion 55, and the arch portion 53 are configured to cooperatively provide the pseudo-planar insole insert 1 with the ability to permit a user's foot to be secure and stable as necessary for appropriate flexing and movement of the bone structure throughout the supported phases of gait in most existing footwear that do not otherwise provide such security and stability. As an added benefit of the pseudo-planar insole insert 1, the metatarsal cutout 87, the heel portion 55, and the arch portion 53 are configured such that cooperative interaction there among largely minimizes or eliminates excessive inward rotation of the user's leg to thereby reduce knee and hip discomforts sometimes associated therewith. In addition, and particularly for users having flat feet, the body member 11, the metatarsal cutout 87, the heel portion 55, and the arch portion 53 are configured such that cooperative interaction there among will more naturally balance the extrinsic muscles on the top and bottom of the user's foot to thereby minimize or entirely eliminate the maladies commonly referred to as bunions and hammertoes.

A state-of-the-art system, developed for measuring the distribution of weight-generated forces applied to the sole of a user's foot, sometimes referred to as "F-scan in-shoe gait analysis", was used to evaluate the inventive features of the pseudo-planar insole insert 1 of the present invention. The F-scan system uses paper-thin insole devices, each approximately 0.007-inch thick and containing on the order of a thousand individual sensors. The F-scan insole devices are flexible and may be trimmed to custom fit almost any shoe size or shape. During evaluations, the F-scan insoles are attached directly to the bottom of a sock or the skin of a user's sole before insertion into footwear. The bi-pedal plantar pressures at each of the sensors are then detected, monitored, and recorded by the F-scan system as they sequentially occur during a normal gait cycle and/or during stance. The results may then be compared with similar measurements taken with the same or similar footwear, one set with modifications such as the pseudo-planar insole insert 1, and one set without such modifications.

In regard to the present invention, F-scan computerized gait analysis system was used for diagnostic evaluations of footwear not providing the benefits of the pseudo-planar insole insert 1 and compared with corresponding diagnostic evaluations of footwear utilizing the pseudo-planar insole insert 1 of the present invention. A comparison of two corresponding sets of F-scan data disclosed that the greatest weight-generated forces at the center of the user's heel were reduced from 22.2 kilograms per square centimeter ($kg/cm^2$) without the pseudo-planar insole insert 1 to 19.7 $kg/cm^2$ with the pseudo-planar insole insert 1, or a reduction in excess of eleven percent; at the greatest weight-generated forces applied to the sesamoids of the user's foot were reduced from 17.8 $kg/cm^2$ without the pseudo-planar insole insert 1 to 13.5 $kg/cm^2$ with the pseudo-planar insole insert 1, or a reduction in excess of twenty-four percent; and at the greatest weight-generated forces applied to the fifth metatarsal head of the user's foot were reduced from 26.0 $kg/cm^2$ without the pseudo-planar insole insert 1 to 13.5 $kg/cm^2$ with the pseudo-planar insole insert 1, or a reduction of approximately forty-eight percent.

In other words, the F-scan analysis clearly demonstrated that the larger weight-generated forces normally applied to localized regions of the user's foot sole were indeed redistributed toward other regions of the user's foot sole normally experiencing smaller weight-generated forces to thereby substantially reduce the range of applied weight-generated forces.

Briefly stated, the pseudo-planar insole insert 1 of the present invention comprises a first planar material positioned for attenuating the impact forces applied to the user's foot and other skeletal structures during standing, walking and running, and a combination of the first planar material with a, generally thinner, profiled second planar material for firm supporting the user's foot.

The material of the first member 13 and the second member 23 compresses relatively easily when loaded. However, the regions of the pseudo-planar insole insert 1 wherein the first member 13 is superimposed over the second member 23 do not compress as compactly when loaded as those regions wherein the first member 13 is not superimposed over the second member 23. Therefore, the regions of the body member 11 that include the combination of both the first member 13 and the second member 23 are configured to, among other things, compress and provide firmer support for the corresponding regions of the user's foot, whereas the regions of the body member 11 that include only the first member 13, but not the second member 23, are configured to, among other things, redistribute some of the larger weight-generated forces normally bearing against the user's sole in the regions corresponding to those regions of the first member 13 not supported by the second member 23 toward those regions of the first member 13 that are supported by the second member 23.

In other words, the region of the body member 11 corresponding to the arch portion 53 finely supports the osseous alignment of the user's foot when in the neutral position thereby relieving stress in the ligaments, muscles and tendons which maintain the foot in that position. During toe-off, the arch portion 53 provides necessary support for the second and third (and perhaps fourth, N4) metatarsal necks N2, N3, but the region of the first member 13 corresponding to the metatarsal cutout 87 permits the first metatarsal neck N1 and head M1 to plantarflex relative to the second and third metatarsal heads M2, M3.

The structural and contour features of the first member 13 in combination with the second member 23 are configured to cooperatively provide the pseudo-planar insole insert 1 with the ability to permit a user's foot to be secure and stable as necessary for appropriate flexing and movement of the bone structure throughout the phases of gait in most existing footwear that do not otherwise provide such security and stability.

The resiliency of the lateral portion 67 of the heel portion 55 of the pseudo-planar insole insert 1, in addition to cooperatively redistributing weight-generated forces applied to the user's foot, also provides cushioning for those initial impacts to thereby reduce risk of injury to the user and to thereby support and promote enhanced efficiency of other associated parts of the user's foot and lower skeletal structure.

In an application of the present invention wherein the pseudo-planar insole insert 1 is appropriately installed in existing footwear and worn on a user's foot, some of the primary benefits provided by the pseudo-planar insole insert 1 while walking and running begin at heel strike, when the heel of the user's footwear first hits the underlying supporting surface.

After each such initial impact, the user's foot pivots distally about his heel, with the lateral sides of his arch and forefoot impacting against the underlying supporting surface and his foot pronating to a neutral position with the central vertical plane of his heel generally appropriately oriented perpendicularly to the underlying supporting surface. Again, resiliency of the body member 11 of the pseudo-planar insole insert 1 provides cushioning for the shocks arising from such secondary impacts. As the user's metatarsal phalangeal joints moves downwardly, the first metatarsal phalangeal joint stabilizes as it must before the user's foot subsequently lifts from the underlying supporting surface. The lesser phalangeal joints are accordingly stabilized due to the contours of the second member 23, including the metatarsal cutout 87 for the first metatarsal phalangeal joint J1.

The resiliency of the body member 11 beneath the user's metatarsal heads M1–M5 also serves to attenuate and/or redistribute weight-generated forces applied there against during mid-stance through propulsive phases of his gait cycle. The described motion places the user's foot in an appropriate biomechanical position for the propulsive phase of his gait cycle, including proper displacing of his sesamoid apparatus during mid-stance and toe-off phases. In addition, the cooperative interaction by the heel portion 55, the arch portion 53, and the body member 11 allows the sesamoids and certain muscles of the user's foot to momentarily rest to thereby create a desirable timing sequence thereof and, particularly in conjunction with the metatarsal cutout 87, to create a more effective lever system just prior to the foot progressing into the toe-off phase of his gait.

As the user's foot rotates forwardly into the toe-off phase, the first metatarsal M1 is permitted by the interaction between the first member 13 and the second member 23 to be appropriately pushed downwardly, remaining stable, particularly due to the support provided to the second and third metatarsals by the second member 23 as the user's heel lifts from the underlying supporting surface, and continuing to remain stable and appropriately flex without movement upward or forward up to the position in the user's gait whereat the first metatarsal phalangeal joint J1 lifts from the underlying supporting surface. In other words, as the user's heel lifts from the underlying supporting surface, the pseudo-planar insole insert 1 allows the user's first metatarsal phalangeal joint J1 to actually displace downwardly to continue to be stabilized, thereby progressively providing appropriate functioning of the user's foot throughout the entire supported phases of his gait.

One of the primary reasons the user's foot remains stable throughout the supported phases of his gait is because the structure of the pseudo-planar insole insert 1 provides support and stability for each of the user's heel, arch, and first metatarsal from before the user's foot rotates forwardly, whereat his heel lifts from the underlying supporting surface, to the point in the user's gait whereat the user's first metatarsal actually lifts from the underlying supporting surface. Thus, the pseudo-planar insole insert 1 appropriately provides all of the necessary supporting and stabilizing factors while allowing the user's foot to function appropriately within the confines of his shoe.

It should now be obvious from the foregoing that the material properties of the various regions of the pseudo-planar insole insert 1 appropriately cushion, support and stabilize various parts of the user's foot as herein described. It should also now be obvious that the resiliencies hereinbefore described may be altered, depending upon the intended use of the footwear for which the pseudo-planar insole insert 1 is intended. For example, adult footwear designed for use in situations where the wearer will frequently be carrying a heavy load (e.g., work boots) may require more support than a child's dress shoe. Likewise, footwear made for running may require firmer support in the heel section to thereby absorb the greater initial shock of each running step than would a hiking boot in which more cushioning may be desired for each walking step. Further, it will be appreciated that the present invention is not limited necessarily to any particular type of footwear and may be equally desirable for use in shoes and boots.

Use of the pseudo-planar insole insert 1 of the present invention in a child's shoe should preferably be initiated as soon as the infant's feet become weight-bearing to thereby aid the child in standing and walking, to mold the child's foot into an appropriate position that does not interfere with the foot's normal ontogenetic development, and to provide substantially full and complete support between the child's foot and the underlying supporting surface.

It is to be understood that the invention described herein is equally applicable to insole inserts for infant, toddler, and youth as well as adult footwear and that, while certain forms of the present invention have been illustrated and described herein, it is not to be limited to the specific forms or arrangement of parts described and shown.

What is claimed and desired to be secured by letters patent is as follows:

1. An insole insert for a user's footwear, said insole insert comprising a body having:

(a) a planar first member constructed of flexible material, said first member having a toe edge, a heel edge, a lateral side edge, and a medial side edge; and (b) a planar second member constructed of flexible material and connected to said first member, said second member having:

(1) a heel portion with a medial portion extending along said medial side edge, a rear portion extending along said heel edge, and a lateral portion extending along said lateral side edge of said first member;

(2) an arch portion; and (3) a metatarsal cutout dimensioned and configured to be generally operatively centered beneath the user's first metatarsal joint; said metatarsal cutout including means, cooperatively with said first member and said second member, for allowing the user's first metatarsal phalangeal joint and his sesamoids therebelow to appropriately plantarflex between the midstance and toe-off phases of the user's gait; and (c) wherein said heel portion and said arch portion include means for operatively and cooperatively redistributing weight-generated forces operatively bearing against the sole of the user's foot such that greater weight-generated forces normally bearing against certain regions of the sole of the user's foot are substantially reduced and redistributed toward other regions of the user's foot whereat normally smaller weight-generated forces normally bear against the user's foot.

2. The insole insert of claim 1, wherein said first member has a substantially uniform thickness.

3. The insole insert of claim 2, wherein said first member has a thickness in the range of approximately two to six millimeters.

4. The insole insert of claim 2, wherein said first member has a thickness of approximately five millimeters.

5. The insole insert of claim 1, wherein said second member has a substantially uniform thickness.

6. The insole insert of claim 5, wherein said second member has a thickness in the range of approximately two to six millimeters.

7. The insole insert of claim 5, wherein said second member has a thickness of approximately two millimeters.

8. The insole insert of claim 1, wherein the thickness of said second member is substantially less than the thickness of said first member.

9. The insole insert of claim 1, wherein the thickness of said second member is substantially equal to the thickness of said first member.

10. The insole insert of claim 1, wherein the thickness of said second member is greater than the thickness of said first member.

11. The insole insert of claim 1, wherein said metatarsal cutout has a longitudinal edge spaced operatively between the user's first and second metatarsals.

12. The insole insert of claim 1, wherein said metatarsal cutout has a transverse edge spaced operatively just rearwardly from the user's first metatarsal phalangeal joint.

13. The insole insert of claim 1, including a heel cutout in said second member, said heel cutout generally operatively centered beneath the user's heel whereat the greatest weight-generated forces are normally applied.

14. The insole insert of claim 1, further including said second member having an intermediate edge operatively spaced beneath at least the user's second and third metatarsal necks.

15. The insole insert of claim 1, further including said second member having an intermediate edge operatively spaced beneath the user's second through fourth metatarsal necks.

16. The insole insert of claim 1, further including said second member having an intermediate edge operatively spaced beneath the user's second through fourth proximal phalanges.

17. The insole insert of claim 1, wherein said heel portion and said arch portion include means for cooperatively redistributing the greater weight-generated forces normally applied to the inner and more bony regions of the user's heel outwardly toward the outer and more fleshy regions of the user's heel.

18. The insole insert of claim 1, wherein said heel portion and said arch portion include means for suspending mid-portions of the user's foot to cooperatively redistribute the greater weight-generated forces normally applied to the inner and more bony regions of the user's heel outwardly toward the outer and more fleshy regions of the user's heel.

19. The insole insert of claim 1, wherein said heel portion and said arch portion include means for cooperatively reducing the maximum weight-generated forces applied to the center of the user's heel to approximately eleven percent of the maximum weight-generated forces that would otherwise be applied to the center of the user's heel without the benefit of said insole insert.

20. The insole insert of claim 1, wherein said heel portion and said arch portion include means for cooperatively reducing the maximum weight-generated forces applied to the user's sesamoids to approximately twenty-four percent of the maximum weight-generated forces that would otherwise be applied to the user's sesamoids without the benefit of said insole insert.

21. The insole insert of claim 1, wherein said heel portion and said arch portion include means for cooperatively reducing the maximum weight-generated forces applied to the user's fifth metatarsal head to approximately forty-eight percent of the maximum weight-generated forces that would otherwise be applied to the user's fifth metatarsal head without the benefit of said insole insert.

22. The insole insert of claim 1, wherein:

(a) said second member has an inner edge along said heel portion and said arch portion; and (b) said first member includes means for operatively moderating any ridging effects in the sole of a user's foot by said inner edge.

23. The insole insert of claim 1, wherein said second member has an inner edge configured to operatively pass beneath at least the second and third metatarsal necks of the user's foot and to operatively pass beneath the first metatarsal neck of the user's foot.

24. The insole insert of claim 1, wherein said second member has an inner edge configured to operatively pass beneath the lateral cuneiform bone of the user's foot.

25. The insole insert of claim 1, wherein said second member has an inner edge configured to operatively pass beneath the navicular bone of the user's foot.

26. The insole insert of claim 1, wherein said first member and said second member are integrally formed from a single material.

27. The insole insert of claim 26, wherein said material has a hardness of less than 70 on the Shore C Scale.

28. The insole insert of claim 26, wherein said material has a hardness in the range of approximately 40–65 on the Shore C Scale.

29. The insole insert of claim 26, wherein said material has a hardness of approximately 55 on the Shore C Scale.

30. The insole insert of claim 26, wherein said material is comprised of blown thermoplastic rubber.

31. The insole insert of claim 1, including said lateral portion being configured to extend distally to approximately beneath a distal end of the lateral margin of the plantarly calcaneal tuberosity of the user's foot.

32. The insole insert of claim 1, wherein said first member is constructed of non-cellular material and said second member is constructed of cellular material.

33. The insole insert of claim 1, wherein said heel portion has a U-shaped configuration.

34. The insole insert of claim 1, wherein said medial portion, said rear portion and said lateral portion of said heel portion have widths in the approximate range of ¼ inch to ¾ inch, depending on size of the user's foot.

35. The insole insert of claim 1, wherein said heel portion and said arch portion includes means for increasing a portion of the user's weight supported by the regions of the user's foot between the user's heel and forefoot to provide a bridging effect which operatively reduces the overall weight-bearing forces applied to the user's heel and forefoot during the midstance phase of the user's gait.

36. An pseudo-planar insole insert for a user's footwear, said insole insert comprising a body having:

(a) a planar first member constructed of flexible material and having a uniform thickness, said first member having a heel edge, a lateral side edge, and a medial side edge; and (b) a planar second member constructed of flexible material and having a uniform thickness that is substantially thinner than the thickness of said first member, said second member having:

(1) a heel portion with a medial portion extending along said medial side edge, a rear portion extending along said heel edge, and a lateral portion extending along said lateral side edge of said first member, (2) an arch portion configured such that a foremost extremity thereof operatively passes beneath the second and third metatarsal necks of the user's foot, and (3) an inner edge configured to operatively pass beneath the lateral cuneiform bone and the navicular bone of the user's foot;

(c) a metatarsal cutout formed in said second member, said metatarsal cutout dimensioned and configured to be generally operatively centered beneath the user's first metatarsal joint; said metatarsal cutout having a longitudinal edge spaced operatively between the user's first and second metatarsals and a transverse edge spaced operatively just rearwardly from the user's first metatarsal to pass beneath the first metatarsal neck of the user's foot; and (d) a longitudinally shaped heel cutout formed in said second member, said heel cutout dimensioned and structured to be generally operatively centered beneath the user's heel; and (e) wherein:

(1) said heel portion, said arch portion, said metatarsal cutout, and said heel cutout are dimensioned and configured to:

(A) cooperatively redistribute weight-generated forces normally bearing against the heel, sesamoids, and fifth metatarsal head of the user's foot such that greater weight-generated forces normally bearing against the more bony regions of the heel, sesamoids, and first metatarsal head of the user's foot are substantially reduced and redistributed toward other larger and more fleshy regions of the user's foot, and (B) cooperatively allow the user's first metatarsal phalangeal joint and sesamoids therebelow to appropriately plantarflex between the midstance and toe-off phases of the user's gait, and (2) said thickness of said first member is dimensioned to operatively moderate any ridging and creasing effects in the sole of the user's foot by said second member.

* * * * *